US011177057B2

(12) United States Patent
Liu et al.

(10) Patent No.: US 11,177,057 B2
(45) **Date of Patent: *Nov. 16, 2021**

(54) BASE METAL ELECTRODES FOR METAL OXIDE VARISTOR

(71) Applicant: Dongguan Littelfuse Electronics Company Limited, Dongguan (CN)

(72) Inventors: Shuying Liu, Dongguan (CN); Ming Lei, Dongguan (CN); Guoliang Chen, Dongguan (CN); Youqun Sui, Dongguan (CN)

(73) Assignee: Dongguan Littelfuse Electronics, Co., Ltd, Dongguan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/071,234

(22) Filed: Oct. 15, 2020

(65) Prior Publication Data

US 2021/0027921 A1 Jan. 28, 2021

Related U.S. Application Data

(63) Continuation of application No. 16/609,692, filed as application No. PCT/CN2017/084539 on May 16, 2017, now Pat. No. 10,839,993.

(51) Int. Cl.
*H01C 7/108* (2006.01)
*H01C 1/142* (2006.01)
(Continued)

(52) U.S. Cl.
CPC ..... *H01C 7/108* (2013.01); *H01C 1/142* (2013.01); *H01C 17/006* (2013.01); *H01C 17/281* (2013.01)

(58) Field of Classification Search
CPC ..... H01C 7/108; H01C 1/142; H01C 17/006; H01C 17/281
See application file for complete search history.

(56) References Cited

U.S. PATENT DOCUMENTS 4,103,274 A 7/1978 Burgess et al.
4,448,806 A 5/1984 Levinson
(Continued)

FOREIGN PATENT DOCUMENTS

CN 101436454 A 5/2009
CN 101436455 A 5/2009
(Continued)

*Primary Examiner* — Kyung S Lee
(74) *Attorney, Agent, or Firm* — Kacvinsky Daisak Bluni PLLC

(57) ABSTRACT

A MOV device including a MOV chip, a first base metal electrode disposed on a first side of the MOV chip, and a second base metal electrode disposed on a second side of the MOV chip opposite the first side, each of the first base metal electrode and the second base metal electrode including a first base metal electrode layer disposed on a surface of the MOV chip and formed of one of silver, copper, and aluminum, the first base metal electrode layer having a thickness in a range of 2-200 micrometers, and a second base metal electrode layer disposed on a surface of the first base metal electrode layer and formed of one of silver, copper, and aluminum, the second base metal electrode layer having a thickness in a range of 2-200 micrometers.

5 Claims, 16 Drawing Sheets

(51) Int. Cl.
*H01C 17/00* (2006.01)
*H01C 17/28* (2006.01)

(56) References Cited

U.S. PATENT DOCUMENTS

| | | | | |
|---|---|---|---|---|
| 4,538,347 | A | 9/1985 | Palilla et al. | |
| 4,975,674 | A | 12/1990 | Sumiyoshi | |
| 5,608,596 | A | 3/1997 | Smith | |
| 6,199,268 | B1 | 3/2001 | Greuter | |
| 8,077,008 | B2 | 12/2011 | McLoughlin | |
| 10,839,993 | B2 * | 11/2020 | Liu | H01C 17/281 |
| 2008/0024264 | A1 | 1/2008 | Schilloff | |
| 2008/0157917 | A1 | 7/2008 | Tu | |
| 2014/0339955 | A1 | 11/2014 | Tseng | |
| 2016/0035466 | A1 | 2/2016 | Xu et al. | |
| 2016/0125983 | A1 | 5/2016 | Hsu | |

FOREIGN PATENT DOCUMENTS

| | | | |
|---|---|---|---|
| CN | 203376986 | U | 1/2014 |
| CN | 203596230 | U | 5/2014 |
| CN | 106531379 | A | 3/2017 |
| JP | 6123302 | B2 | 5/2014 |

* cited by examiner

BASE METAL ELECTRODES FOR METAL OXIDE VARISTOR

CROSS REFERENCE TO RELATED APPLICATION

This application is a continuation of, and claims the benefit of priority to, U.S. patent application Ser. No. 16/609,692, filed Oct. 30, 2019, entitled "Base Metal Electrodes for Metal Oxide Varistor," which is a 371 of International Application PCT/CN2017/084539 filed May 16, 2017, entitled "Base Metal Electrodes for Metal Oxide Varistor," now issued as U.S. Pat. No. 10,839,993, which application is incorporated herein by reference in its entirety.

FIELD OF THE DISCLOSURE

The present disclosure relates generally to the field of voltage suppression devices, and relates more particularly to low-cost electrodes for metal oxide varistors and methods of manufacturing the same.

Metal oxide varistors (MOVs) are voltage dependent, nonlinear devices that are commonly employed in electronic circuits for providing transient voltage suppression. A typical MOV device includes a metal oxide ceramic chip (the MOV) having base metal electrodes disposed on opposite sides thereof. Electrical leads may be connected (e.g., soldered) to the base metal electrodes to facilitate electrical connection of the MOV device within a circuit.

The base metal electrodes of MOV devices are traditionally formed of silver paste printed onto the surfaces of a metal oxide ceramic chip. After printing, the base metal electrodes are fired, whereby the silver paste is hardened and securely adhered to the metal oxide varistor chip. Due to the high cost of silver, the base metal electrode layers are typically the most expensive components of a MOV device, and are therefore the components that contribute most to the overall production cost of a MOV device.

The market for MOV devices is highly cost-driven. Manufactures of MOV devices therefore strive to minimize production costs in order to offer products at competitive prices. It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A MOV device in accordance with an exemplary embodiment of the present disclosure may include a MOV chip, a first base metal electrode disposed on a first side of the MOV chip, and a second base metal electrode disposed on a second side of the MOV chip opposite the first side, each of the first base metal electrode and the second base metal electrode including a first base metal electrode layer disposed on a surface of the MOV chip and formed of one of silver, copper, and aluminum, the first base metal electrode layer having a thickness in a range of 2-200 micrometers, and a second base metal electrode layer disposed on a surface of the first base metal electrode layer and formed of one of silver, copper, and aluminum, the second base metal electrode layer having a thickness in a range of 2-200 micrometers.

Another MOV device in accordance with an exemplary embodiment of the present disclosure may include a MOV chip, a first base metal electrode disposed on a first side of the MOV chip, a second base metal electrode disposed on a second side of the MOV chip opposite the first side, each of the first base metal electrode and the second base metal electrode formed of aluminum and having a thickness in a range of 5-200 micrometers, and first and second leads connected directly to the first and second base metal electrodes, respectively.

A method of forming a MOV device in accordance with an exemplary embodiment of the present disclosure may include providing a MOV chip, forming first base metal electrode layers on opposing first and second surfaces of the MOV chip, the first base metal electrode layers formed of one of silver, copper, and aluminum and having thicknesses in a range of 2-200 micrometers, and forming second base metal electrode layers on the first base metal electrode layers, the second base metal electrode layers formed of one of silver, copper, and aluminum and having thicknesses in a range of 2-200 micrometers.

DETAILED DESCRIPTION

Figure 1A:
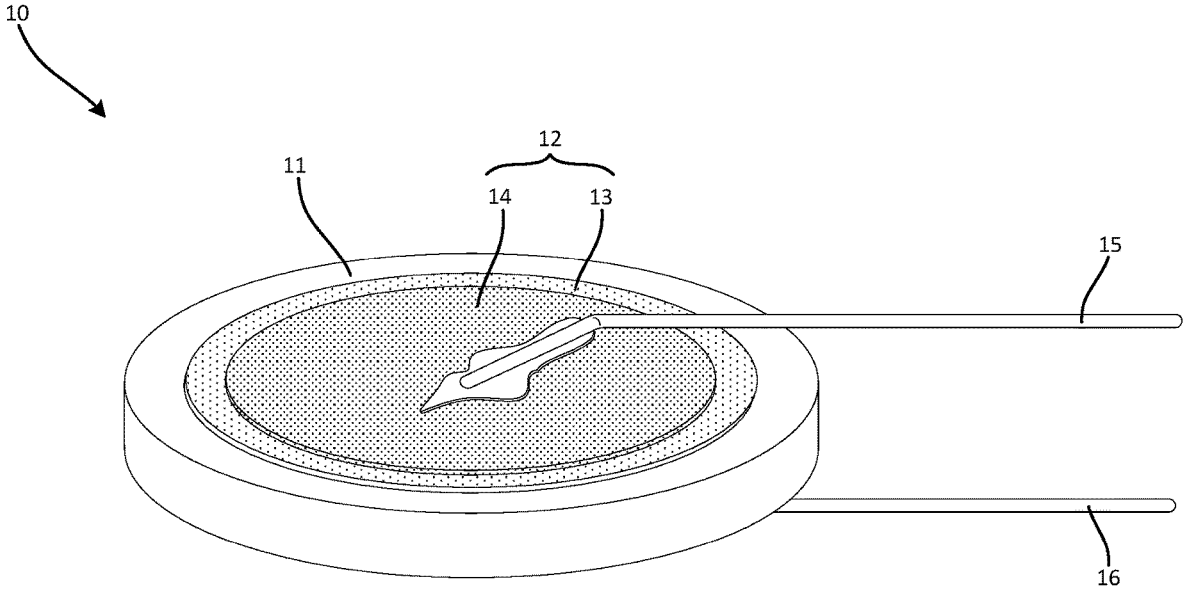
FIG. 1*a* is a perspective view illustrating a MOV device in accordance with an exemplary embodiment of the present disclosure.

Embodiments of a metal oxide varistor (MOV) device and methods for manufacturing the same in accordance with the present disclosure will now be described more fully with reference to the accompanying drawings, in which preferred embodiments of the present disclosure are presented. The MOV devices and the accompanying methods of the present disclosure may, however, be embodied in many different forms and should not be construed as being limited to the embodiments set forth herein. Rather, these embodiments are provided so that this disclosure will convey certain exemplary aspects of the MOV devices and the accompanying methods to those skilled in the art. In the drawings, like numbers refer to like elements throughout unless otherwise noted.

Referring to FIG. 1*a*, an exemplary embodiment of a MOV device 10 in accordance with the present disclosure is shown. The MOV device 10 may include a MOV chip 11 having first and second base metal electrodes 12 disposed on opposite sides thereof. Only one side of the MOV chip 11 is visible in FIG. 1*a*, but it will be understood that the opposing side of the MOV chip 11 that is not within view may be provided with a base metal electrode that is substantially identical to the base metal electrode 12. The description of the base metal electrode 12 provided below shall therefore also apply to the base metal electrode that is not within view in FIG. 1*a*.

The MOV chip 11 may be formed of any MOV composition known in the art, including, but not limited to, zinc oxide granules embedded in ceramic. The base metal electrode 12 may include first and second base metal electrode layers 13, 14. The first base metal electrode layer 13 may be formed of a thin layer of silver paste that is screen-printed onto the surface of the MOV chip 11 using conventional screen-printing processes. In a non-limiting example, the first base metal electrode layer 13 may have a thickness in a range of 2-10 micrometers. Thus, as will be appreciated by those of ordinary skill in the art, the first base metal electrode layer 13 may be significantly thinner than silver base metal electrodes of traditional MOV devices. The second base metal electrode layer 14 may be formed of a layer of copper that may be deposited onto the surface of the first base metal electrode layer 13 using conventional arc-spraying processes. In a non-limiting example, the second base metal electrode layer 14 may have a thickness in a range of 20-200 micrometers.

The MOV chip 11 and the first and second base metal electrode layers 13, 14 are depicted as being circular in shape, but this is not critical. It is contemplated that one or more of the MOV chip 11, the first base metal electrode layer 13, and the second base metal electrode layer 14 may have a different shape, such as rectangular, triangular, irregular, etc. without departing from the scope of the present disclosure. Additionally, while the second base metal electrode layer 14 is depicted as being smaller than the first base metal electrode layer 13 (i.e., smaller in area than the first base metal electrode layer 13), alternative embodiments of the MOV device 10 are contemplated in which the second base metal electrode layer 14 is the same size as, or larger than, the first base metal electrode layer 13.

The MOV device 10 may further include electrically conductive leads 15, 16 which may be connected to the second base metal electrode layers 14 for facilitating electrical connection of the MOV device 10 within a circuit. In various non-limiting embodiments, the leads 15, 16 may be electrically connected to the second base metal electrode layers 14 via soldering, welding, electrically conductive adhesive, etc.

As described above, the first base metal electrode layers 13 of the MOV device 10 are significantly thinner, and therefore require less silver, than silver base metal electrodes of traditional MOV devices. Therefore, the MOV device 10 of the present disclosure may be produced at a lower cost relative to traditional MOV devices.

Figure 1B:
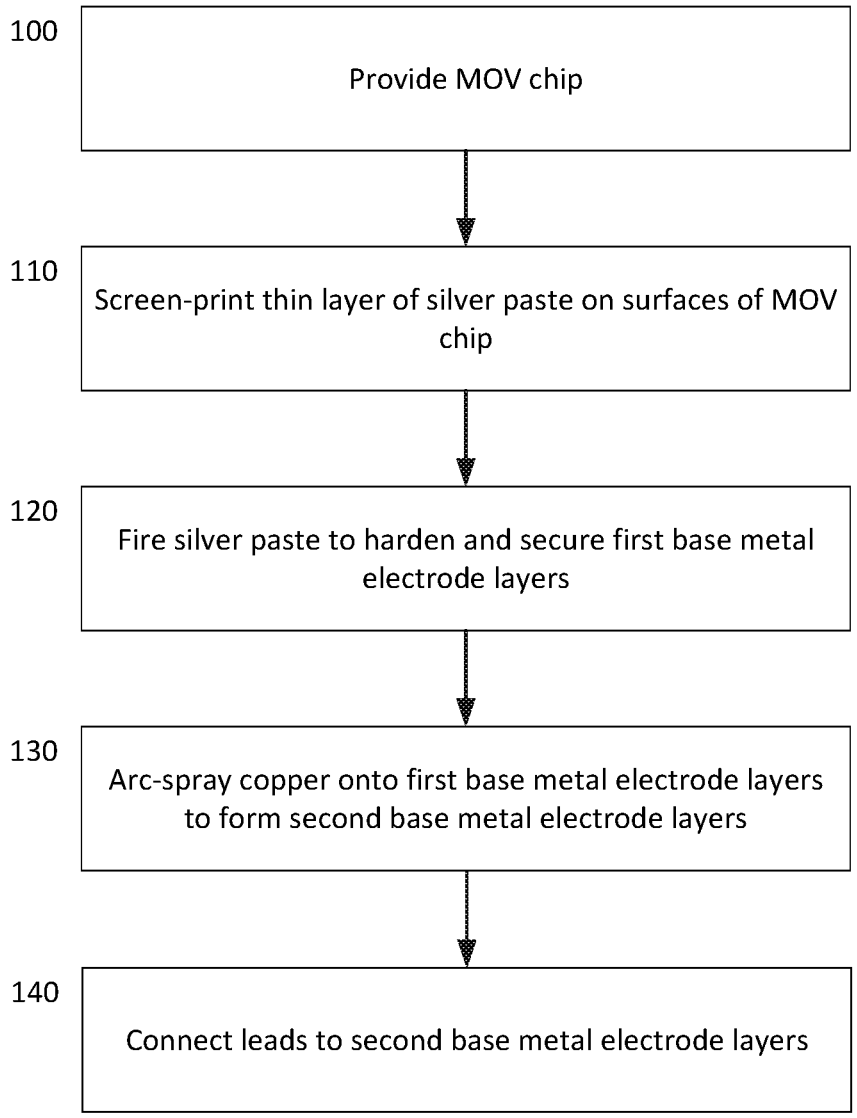
FIG. 1*b* is a flow diagram illustrating an exemplary method of manufacturing the MOV device shown in FIG. 1*a;*

Referring to FIG. 1*b*, a flow diagram illustrating an exemplary method for manufacturing the above-described MOV device 10 in accordance with the present disclosure is shown. The method will now be described in conjunction with the illustration of the MOV device 10 shown in FIG. 1*a*.

At block 100 of the exemplary method, the MOV chip 11 may be provided. As described above, the MOV chip 11 may, in one non-limiting example, be formed of zinc oxide granules embedded in ceramic. In various other embodiments, the MOV chip 11 may be formed of any of a variety of other MOV compositions known in the art for providing transient voltage suppression.

At block 110 of the exemplary method, the first base metal electrode layers 13 may be formed on opposite sides of the MOV chip 11. This may be accomplished by screen-printing thin layers of silver paste on the opposite sides of the MOV chip 11 using conventional screen-printing processes. Subsequently, at block 120 of the method, the screen-printed layers of silver paste may be fired, whereby the silver paste is hardened and securely adhered to the surfaces of the MOV chip 11. In a non-limiting example, the first base metal electrode layers 13 may have a thickness in a range of 2-10 micrometers.

At block 130 of the exemplary method, the second base metal electrode layers 14 may be formed on the first base metal electrode layers 13. This may be accomplished by arc-spraying copper onto the surfaces of the first base metal electrode layers 13 using conventional arc-spraying processes. In a non-limiting example of the method, the second base metal electrode layers 14 may be applied to the first base metal electrode layers 13 using first and second spray guns positioned on opposite sides of the MOV chip 11, thereby allowing the second base metal electrode layers 14 to be applied simultaneously (or nearly simultaneously) and without changing the orientation of the MOV chip 11. Alternatively, the second base metal electrode layers 14 may be applied to the first base metal electrode layers 13 using a single spray gun. In a non-limiting example, the second base metal electrode layers 14 may have a thickness in a range of 20-200 micrometers.

At block 140 of the exemplary method, the leads 15, 16 may be electrically connected to the second base metal electrode layers 14. This may be accomplished via soldering, welding, electrically conductive adhesive, etc.

Figure 2A:
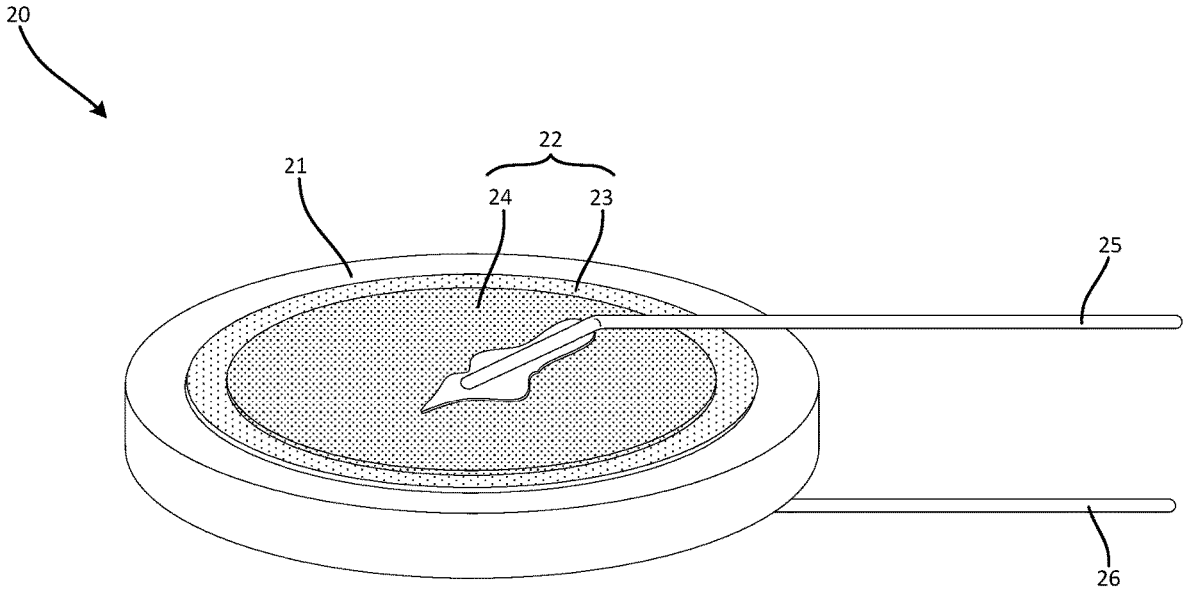
FIG. 2*a* is a perspective view illustrating a MOV device in accordance with another exemplary embodiment of the present disclosure.

Referring to FIG. 2*a*, another exemplary embodiment of a MOV device 20 in accordance with the present disclosure is shown. The MOV device 20 may include a MOV chip 21 having first and second base metal electrodes 22 disposed on opposite sides thereof. Only one side of the MOV chip 21 is visible in FIG. 2*a*, but it will be understood that the opposing side of the MOV chip 21 that is not within view may be provided with a base metal electrode that is substantially identical to the base metal electrode 22. The description of the base metal electrode 22 provided below shall therefore also apply to the base metal electrode that is not within view in FIG. 2*a*.

The MOV chip 21 may be formed of any MOV composition known in the art, including, but not limited to, zinc oxide granules embedded in ceramic. The base metal electrode 22 may include first and second base metal electrode layers 23, 24. The first base metal electrode layer 23 may be formed of a layer of aluminum that may be deposited onto the surface of the MOV chip 21 using conventional arc-spraying processes. In a non-limiting example, the first base metal electrode layer 23 may have a thickness in a range of 20-200 micrometers. The second base metal electrode layer 24 may be formed of a layer of copper that may be deposited onto the surface of the first base metal electrode layer 23 using conventional arc-spraying processes. In a non-limiting example, the second base metal electrode layer 24 may have a thickness in a range of 20-200 micrometers.

The MOV chip 21 and the first and second base metal electrode layers 23, 24 are depicted as being circular in shape, but this is not critical. It is contemplated that one or more of the MOV chip 21, the first base metal electrode layer 23, and the second base metal electrode layer 24 may have a different shape, such as rectangular, triangular, irregular, etc. without departing from the scope of the present disclosure. Additionally, while the second base metal electrode layer 24 is depicted as being smaller than the first base metal electrode layer 23 (i.e., smaller in area than the first base metal electrode layer 23), alternative embodiments of the MOV device 20 are contemplated in which the second base metal electrode layer 24 is the same size as, or is larger than, the first base metal electrode layer 23.

The MOV device 20 may further include electrically conductive leads 25, 26 which may be connected to the second base metal electrode layers 24 for facilitating electrical connection of the MOV device 20 within a circuit. In various non-limiting embodiments, the leads 25, 26 may be electrically connected to the second base metal electrode layers 24 via soldering, welding, electrically conductive adhesive, etc.

As described above, the base metal electrodes 22 of the MOV device 20 are formed of aluminum and copper and do not contain silver. Therefore, since silver is significantly more expensive than either aluminum or copper, the MOV device 20 of the present disclosure may be produced at a lower cost relative to traditional MOV devices that include base metal electrodes formed of silver.

Figure 2B:
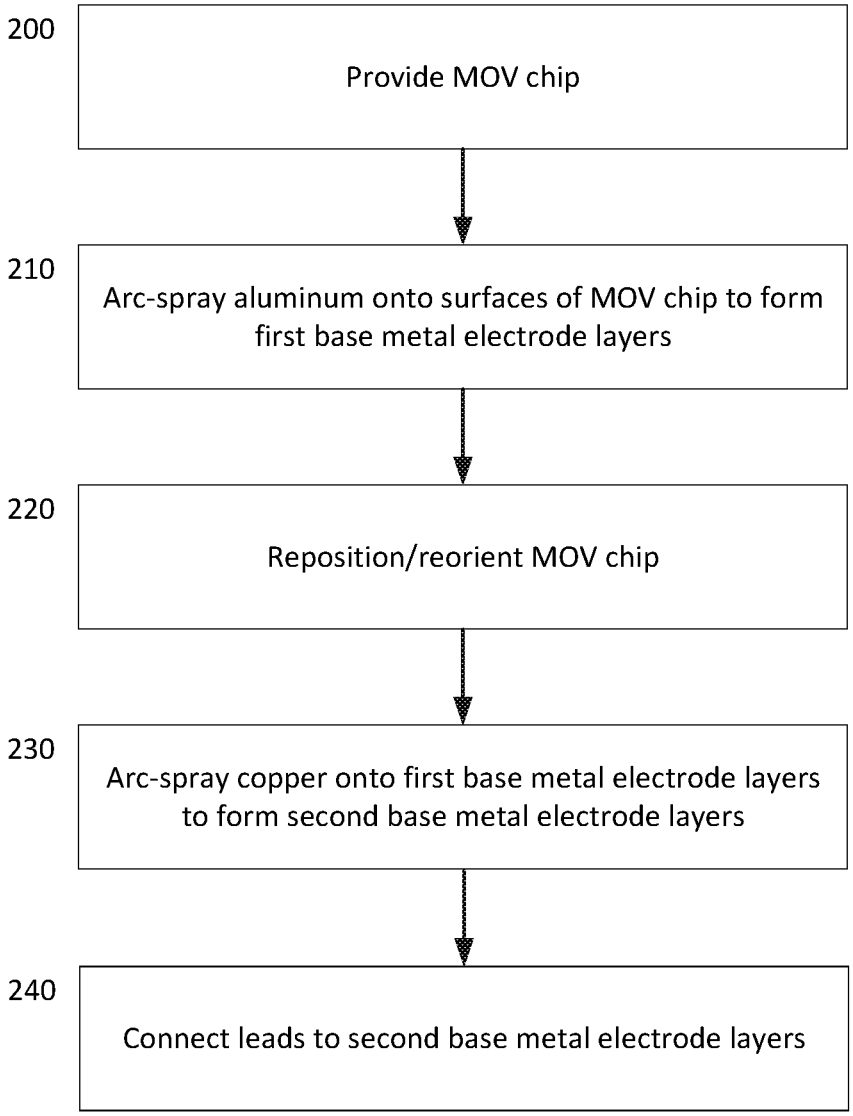
FIG. 2*b* is a flow diagram illustrating an exemplary method of manufacturing the MOV device shown in FIG. 2*a;*

Referring to FIG. 2*b*, a flow diagram illustrating an exemplary method for manufacturing the above-described MOV device 20 in accordance with the present disclosure is shown. The method will now be described in conjunction with the illustration of the MOV device 20 shown in FIG. 2*a*.

At block 200 of the exemplary method, the MOV chip 21 may be provided. As described above, the MOV chip 21 may, in one non-limiting example, be formed of zinc oxide granules embedded in ceramic. In various other embodiments, the MOV chip 21 may be formed of any of a variety of other MOV compositions known in the art for providing transient voltage suppression.

At block 210 of the exemplary method, the first base metal electrode layers 23 may be formed on opposite sides of the MOV chip 21. This may be accomplished by arc-spraying aluminum onto the surfaces of the opposite sides of the MOV chip 21 using conventional arc-spraying processes. In a non-limiting example of the method, the first base metal electrode layers 23 may be applied to the surfaces of the MOV chip 21 using first and second spray guns positioned on opposite sides of the MOV chip 21, thereby allowing the first base metal electrode layers 23 to be applied to the opposite sides of the MOV chip 21 simultaneously (or nearly simultaneously) and without changing the orientation of the MOV chip 21. In a non-limiting example, the first base metal electrode layers 23 may have a thickness in a range of 20-200 micrometers.

At block 220 of the exemplary method, the MOV chip 21 may be repositioned and/or reoriented in preparation for application of the second base metal electrode layers 24. Such repositioning/reorientation will be described in greater detail below.

At block 230 of the exemplary method, the second base metal electrode layers 24 may be formed on the first base metal electrode layers 23. This may be accomplished by arc-spraying copper onto the surfaces of the first base metal electrode layers 23 using conventional arc-spraying processes. In a non-limiting example of the method, the second base metal electrode layers 24 may be applied to the first base metal electrode layers 23 using third and fourth spray guns positioned on opposite sides of the MOV chip 21, thereby allowing the second base metal electrode layers 24 to be applied simultaneously (or nearly simultaneously) and without changing the orientation of the MOV chip 21. In a non-limiting example, the second base metal electrode layers 24 may have a thickness in a range of 20-200 micrometers.

Figure 2C:
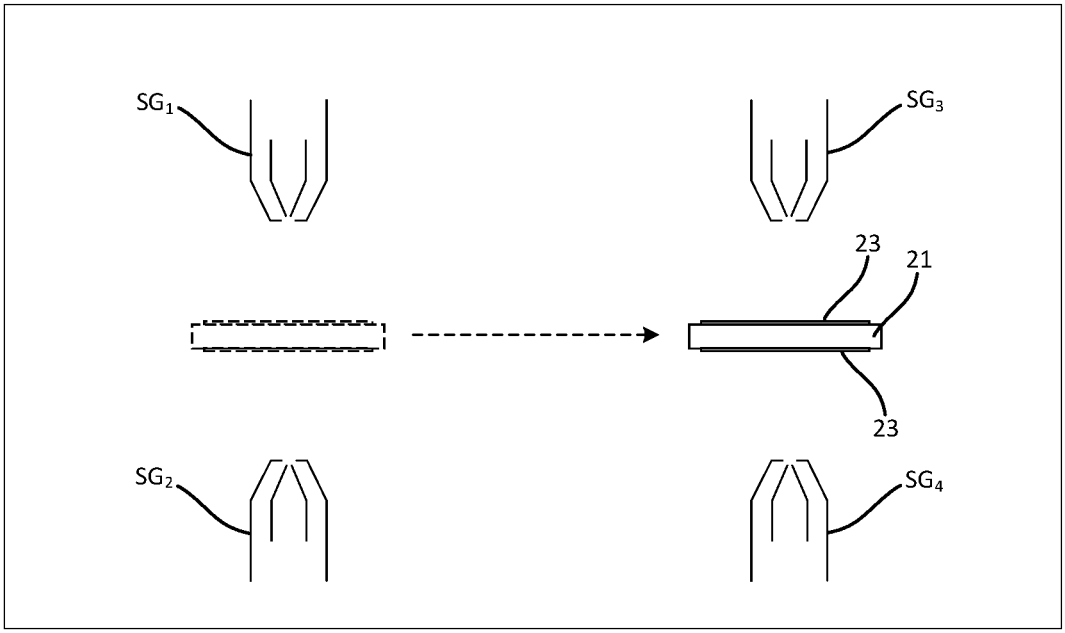
FIGS. 2*c* and 2*d* are schematic illustrations of alternative processes for carrying out a portion of the method set forth in FIG. 2*b;*
Figure 2D:
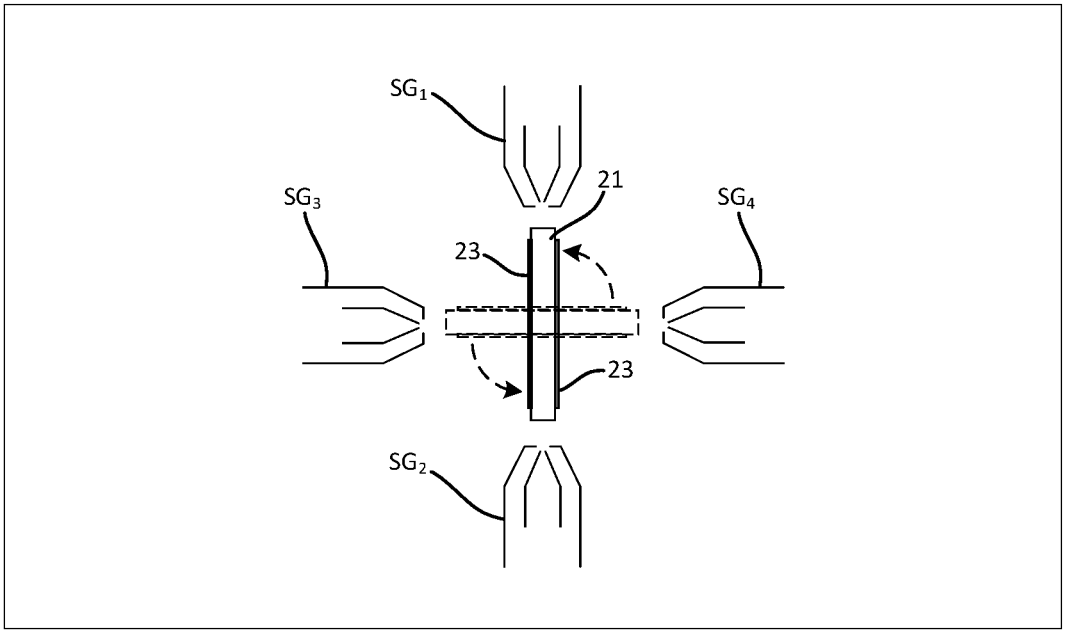

The repositioning/reorientation of the MOV chip 21 performed in block 220 above may be accomplished in at least two different ways for facilitating expedient and efficient application of the first and second base metal electrode layers 23, 24. In one example illustrated in FIG. 2C, the MOV chip 21 may be moved linearly from a position between first and second spray guns SG1, SG2 where the first base metal electrode layers 23 are applied (as in block 210 above) to a position between third and fourth spray guns SG3, SG4 where the second base metal electrode layers 24 are applied (as in block 230 above). In another example illustrated in FIG. 2D, the MOV chip 21 may be rotated (e.g., by 90 degrees) from an orientation perpendicular to first and second spray guns SG1, SG2 in which the first base metal electrode layers 23 are applied (as in block 210 above) to an orientation perpendicular to third and fourth spray guns SG3, SG4 in which the second base metal electrode layers 24 are applied (as in block 230 above).

At block 240 of the exemplary method, the leads 25, 26 may be electrically connected to the second base metal electrode layers 24. This may be accomplished via soldering, welding, electrically conductive adhesive, etc.

Figure 3A:
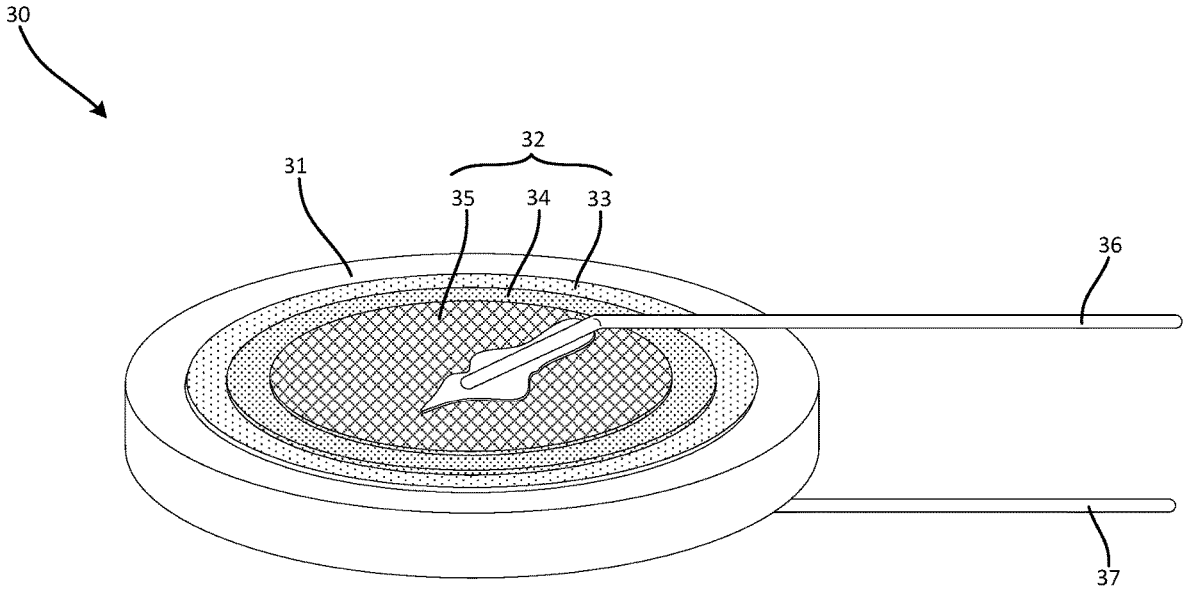
FIG. 3*a* is a perspective view illustrating a MOV device in accordance with another exemplary embodiment of the present disclosure.

Referring to FIG. 3*a*, another exemplary embodiment of a MOV device 30 in accordance with the present disclosure is shown. The MOV device 30 may include a MOV chip 31 having first and second base metal electrodes 32 disposed on opposite sides thereof. Only one side of the MOV chip 31 is visible in FIG. 3*a*, but it will be understood that the opposing side of the MOV chip 31 that is not within view may be provided with a base metal electrode that is substantially identical to the base metal electrode 32. The description of the base metal electrode 32 provided below shall therefore also apply to the base metal electrode that is not within view in FIG. 3*a*.

The MOV chip 31 may be formed of any MOV composition known in the art, including, but not limited to, zinc oxide granules embedded in ceramic. The base metal electrode 32 may include first, second, and third base metal electrode layers 33, 34, 35. The first base metal electrode layer 33 may be formed of a thin layer of aluminum paste that is screen-printed onto the surface of the MOV chip 31 using conventional screen-printing processes. In a non-limiting example, the first base metal electrode layer 33 may have a thickness in a range of 2-10 micrometers.

The second base metal electrode layer 34 may be formed of a layer of aluminum that may be deposited onto the surface of the first base metal electrode 33 using conventional arc-spraying processes. In a non-limiting example, the second base metal electrode layer 34 may have a thickness in a range of 20-200 micrometers. The third base metal electrode layer 35 may be formed of a layer of copper that may be deposited onto the surface of the second base metal electrode layer 34 using conventional arc-spraying processes. In a non-limiting example, the third base metal electrode layer 35 may have a thickness in a range of 20-200 micrometers.

The MOV chip 31 and the first, second, and third base metal electrode layers 33, 34, 35 are depicted as being circular in shape, but this is not critical. It is contemplated that one or more of the MOV chip 31, the first base metal electrode layer 33, the second the base metal electrode layer 34, and the third base metal electrode layer 35 may have a different shape, such as rectangular, triangular, irregular, etc. without departing from the scope of the present disclosure. Additionally, while the second base metal electrode layer 34 is depicted as being smaller than the first base metal electrode layer 33 (i.e., smaller in area than the first base metal electrode layer 33), alternative embodiments of the MOV device 30 are contemplated in which the second base metal electrode layer 34 is the same size as, or is larger than, the first base metal electrode layer 33. Similarly, while the third base metal electrode layer 35 is depicted as being smaller than the second base metal electrode layer 34 (i.e., smaller in area than the second base metal electrode layers 34), alternative embodiments of the MOV device 30 are contemplated in which the third base metal electrode layer 35 is the same size as, or is larger than, the second base metal electrode layer 34.

The MOV device 30 may further include electrically conductive leads 36, 37 which may be connected to the third base metal electrode layers 35 for facilitating electrical connection of the MOV device 30 within a circuit. In various non-limiting embodiments, the leads 36, 37 may be electrically connected to the third base metal electrode layers 35 via soldering, welding, electrically conductive adhesive, etc.

As described above, the base metal electrodes 32 of the MOV device 30 are formed of aluminum and copper and do not contain silver. Therefore, since silver is significantly more expensive than either aluminum or copper, the MOV device 30 of the present disclosure may be produced at a lower cost relative to traditional MOV devices that include base metal electrodes formed of silver.

Figure 3B:
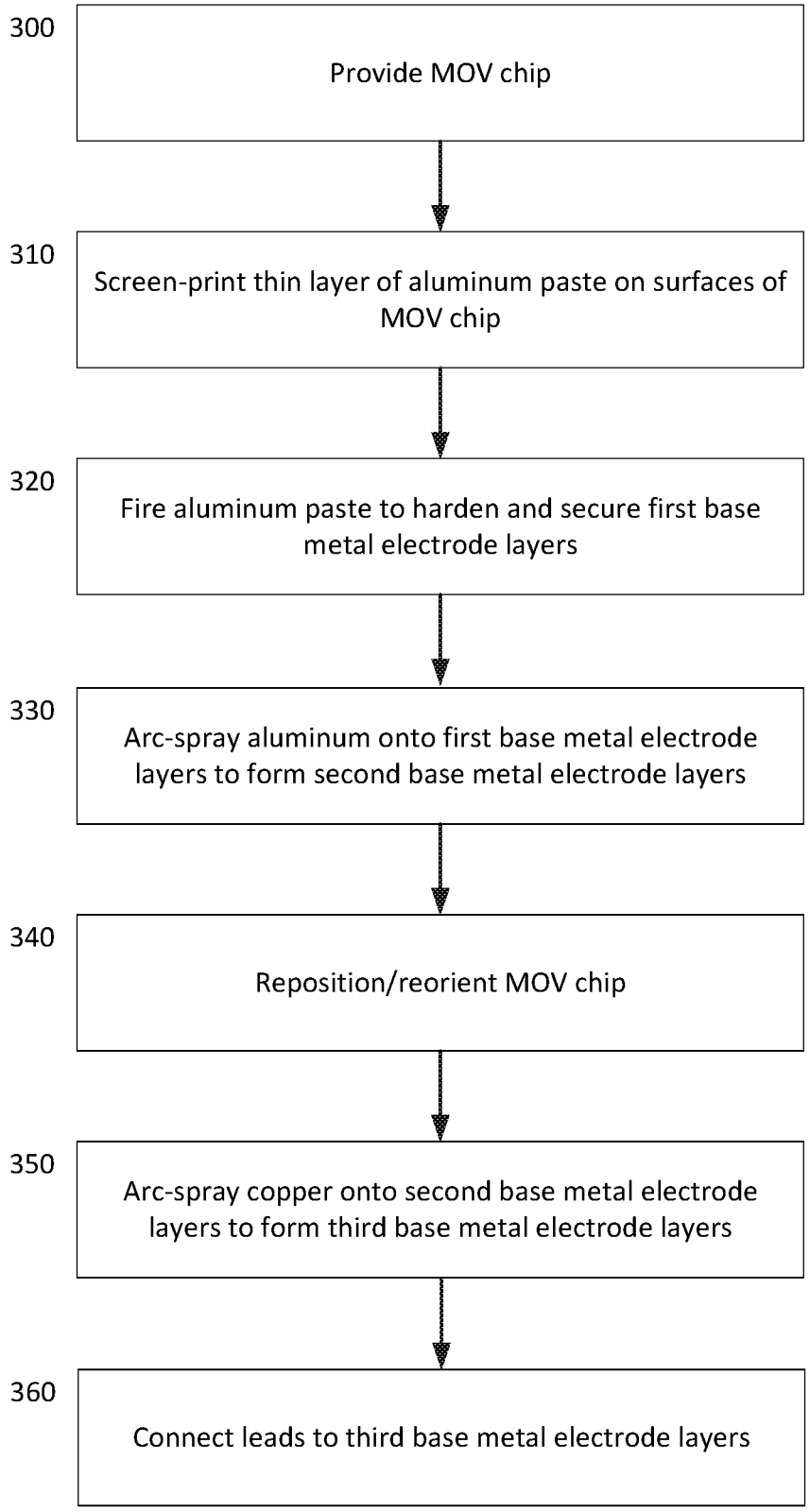
FIG. 3*b* is a flow diagram illustrating an exemplary method of manufacturing the MOV device shown in FIG. 3*a;*

Referring to FIG. 3*b*, a flow diagram illustrating an exemplary method for manufacturing the above-described MOV device 30 in accordance with the present disclosure is shown. The method will now be described in conjunction with the illustration of the MOV device 30 shown in FIG. 3*a*.

At block 300 of the exemplary method, the MOV chip 31 may be provided. As described above, the MOV chip 31 may, in one non-limiting example, be formed of zinc oxide granules embedded in ceramic. In various other embodiments, the MOV chip 31 may be formed of any of a variety of other MOV compositions known in the art for providing transient voltage suppression.

At block 310 of the exemplary method, the first base metal electrode layers 33 may be formed on opposite sides of the MOV chip 31. This may be accomplished by screen-printing thin layers of aluminum paste on the opposite sides of the MOV chip 31 using conventional screen-printing processes. Subsequently, at block 320 of the method, the screen-printed layers of aluminum paste may be fired, whereby the aluminum paste is hardened and securely adhered to the surfaces of the MOV chip 31. In a non-limiting example, the first base metal electrode layers 33 may have a thickness in a range of 2-10 micrometers.

At block 330 of the exemplary method, the second base metal electrode layers 34 may be formed on the first base metal electrode layers 33. This may be accomplished by arc-spraying aluminum onto the surfaces of the first base metal electrode layers 33 using conventional arc-spraying processes. In a non-limiting example of the method, the second base metal electrode layers 34 may be applied to the first base metal electrode layers 33 using first and second spray guns positioned on opposite sides of the MOV chip 31, thereby allowing the second base metal electrode layers 34 to be applied simultaneously (or nearly simultaneously) and without changing the orientation of the MOV chip 31. In a non-limiting example, the second base metal electrode layers 34 may have a thickness in a range of 20-200 micrometers.

At block 340 of the exemplary method, the MOV chip 31 may be repositioned and/or reoriented in preparation for application of the third base metal electrode layers 35. Such repositioning/reorientation will be described in greater detail below.

At block 350 of the exemplary method, the third base metal electrode layers 35 may be formed on the second base metal electrode layers 34. This may be accomplished by arc-spraying copper onto the surfaces of the second base metal electrode layers 34 using conventional arc-spraying processes. In a non-limiting example of the method, the third base metal electrode layers 35 may be applied to the second base metal electrode layers 34 using third and fourth spray guns positioned on opposite sides of the MOV chip 31, thereby allowing the third base metal electrode layers 35 to be applied simultaneously (or nearly simultaneously) and without changing the orientation of the MOV chip 31. In a non-limiting example, the third base metal electrode layers 35 may have a thickness in a range of 20-200 micrometers.

Figure 3C:
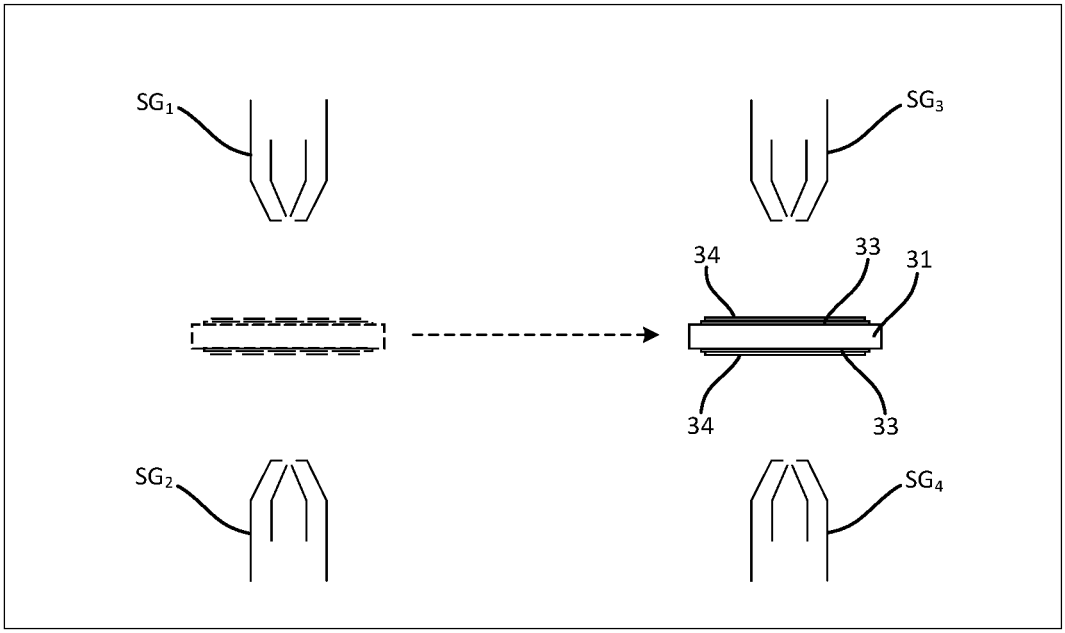
FIGS. 3*c* and 3*d* are schematic illustrations of alternative processes for carrying out a portion of the method set forth in FIG. 3*b;*
Figure 3D:
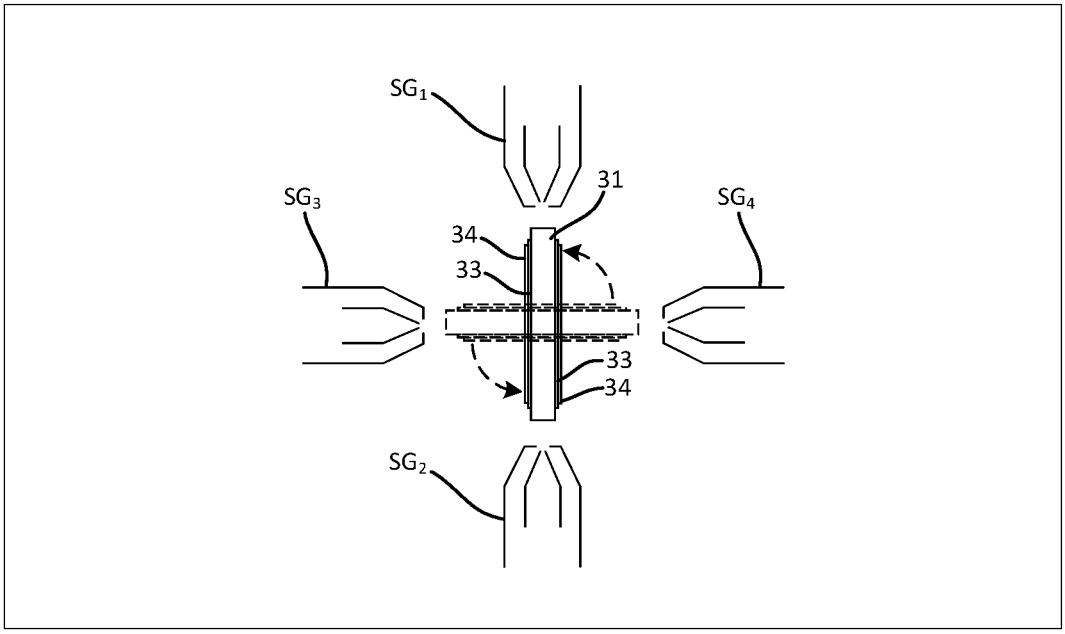

The repositioning/reorientation of the MOV chip 31 performed in block 340 above may be accomplished in at least two different ways for facilitating expedient and efficient application of the second and third base metal electrode layers 34, 35. In one example illustrated in FIG. 3C, the MOV chip 31 may be moved linearly from a position between first and second spray guns SG1, SG2 where the second base metal electrode layers 34 are applied (as in block 330 above) to a position between third and fourth spray guns SG3, SG4 where the third base metal electrode layers 35 are applied (as in block 350 above). In another example illustrated in FIG. 3D, the MOV chip 31 may be rotated (e.g., by 90 degrees) from an orientation perpendicular to first and second spray guns SG1, SG2 in which the second base metal electrode layers 34 are applied (as in block 330 above) to an orientation perpendicular to third and fourth spray guns SG3, SG4 in which the third base metal electrode layers 35 are applied (as in block 350 above).

At block 360 of the exemplary method, the leads 36, 37 may be electrically connected to the third base metal electrode layers 35. This may be accomplished via soldering, welding, electrically conductive adhesive, etc.

Figure 4A:
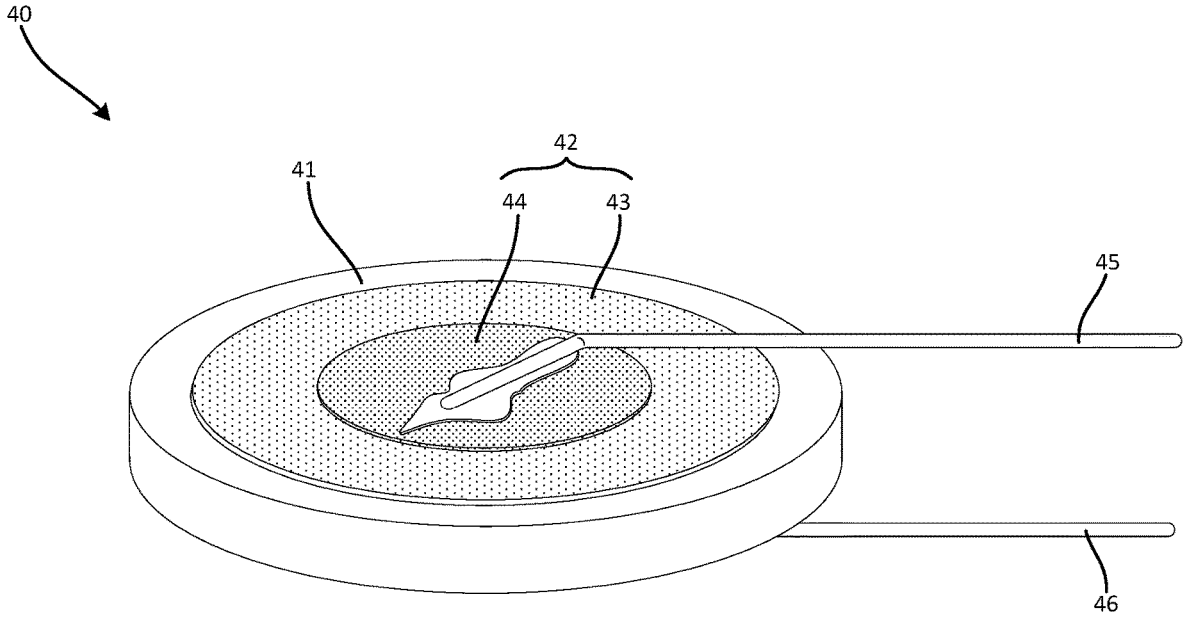
FIG. 4*a* is a perspective view illustrating a MOV device in accordance with another exemplary embodiment of the present disclosure.

Referring to FIG. 4*a*, another exemplary embodiment of a MOV device 40 in accordance with the present disclosure is shown. The MOV device 40 may include a MOV chip 41 having first and second base metal electrodes 42 disposed on opposite sides thereof. Only one side of the MOV chip 41 is visible in FIG. 4*a*, but it will be understood that the opposing side of the MOV chip 41 that is not within view may be provided with a base metal electrode that is substantially identical to the base metal electrode 42. The description of the base metal electrode 42 provided below shall therefore also apply to the base metal electrode that is not within view in FIG. 4*a*.

The MOV chip 41 may be formed of any MOV composition known in the art, including, but not limited to, zinc oxide granules embedded in ceramic. The base metal electrode 42 may include first and second base metal electrode layers 43, 44. The first base metal electrode layer 43 may be formed of a thin layer of aluminum paste that is screen-printed onto the surface of the MOV chip 41 using conventional screen-printing processes. In a non-limiting example, the first base metal electrode layer 43 may have a thickness in a range of 5-30 micrometers.

The second base metal electrode layer 44 may be formed of a thin layer of silver paste that is screen-printed onto the surface of the first base metal electrode layer 43 using conventional screen-printing processes. In a non-limiting example, the second base metal electrode layer 44 may have a thickness in a range of 2-10 micrometers. Thus, as will be appreciated by those of ordinary skill in the art, the second base metal electrode layer 44 may be significantly thinner than silver base metal electrodes of traditional MOV devices. In a non-limiting example, a side of the MOV chip 41 may have a surface area A, the first base metal electrode layer 43 may have a surface area in a range of 60-90% of A, and the second base metal electrode layer 44 may have a surface area that is less than 60% of the surface area of the first base metal electrode layer 43.

The MOV chip 41 and the first and second base metal electrode layers 43, 44 are depicted as being circular in shape, but this is not critical. It is contemplated that one or more of the MOV chip 41, the first base metal electrode layer 43, and the second base metal electrode layer 44 may have a different shape, such as rectangular, triangular, irregular, etc. without departing from the scope of the present disclosure.

The MOV device 40 may further include electrically conductive leads 45, 46 which may be connected to the second base metal electrode layers 44 for facilitating electrical connection of the MOV device 40 within a circuit. In various non-limiting embodiments, the leads 45, 46 may be electrically connected to the second base metal electrode layers 44 via soldering, welding, electrically conductive adhesive, etc.

As described above, the second base metal electrode layers 43 of the MOV device 40 are significantly thinner and smaller, and therefore require less silver, than silver base metal electrodes of traditional MOV devices. Therefore, the MOV device 40 of the present disclosure may be produced at a lower cost relative to traditional MOV devices.

Figure 4B:
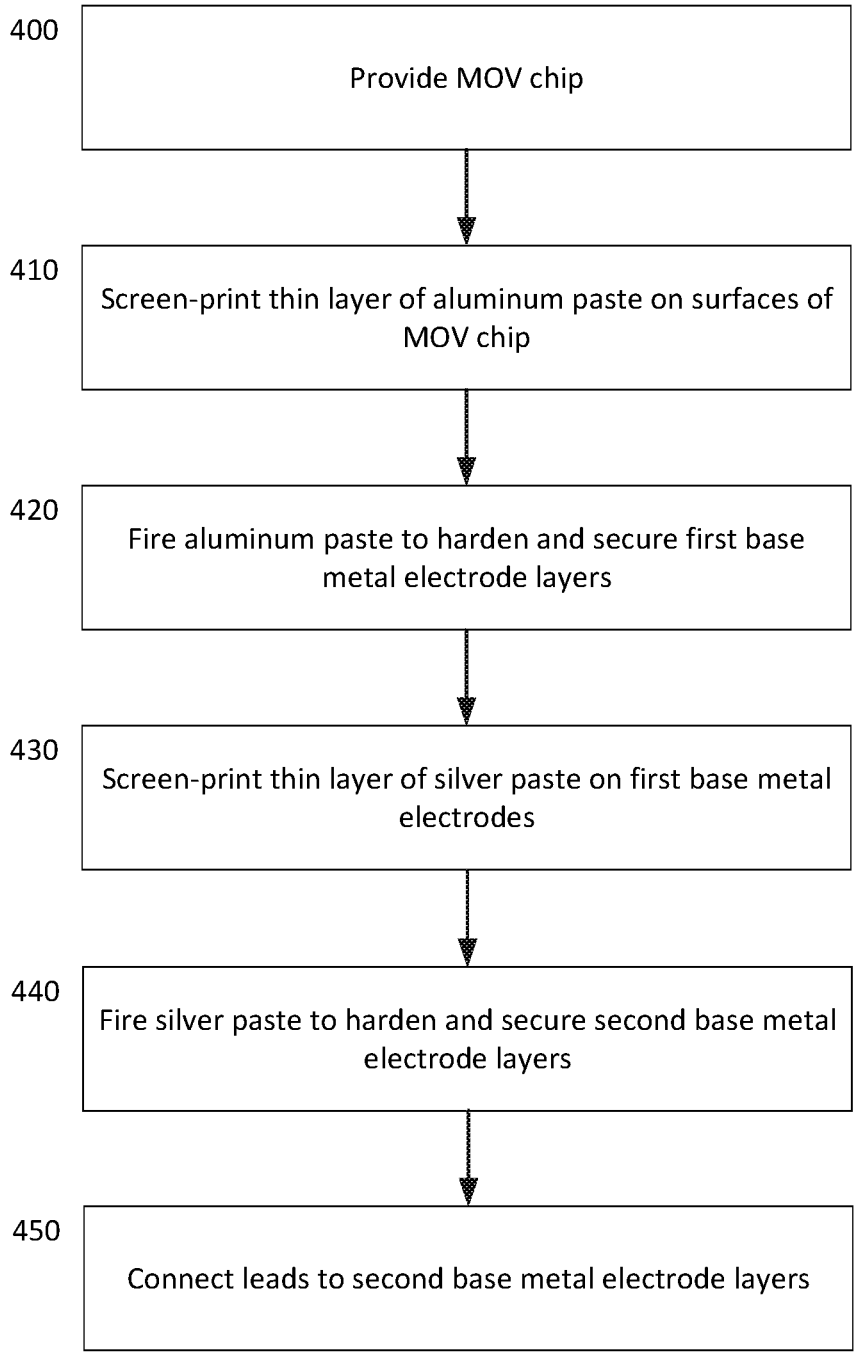
FIG. 4*b* is a flow diagram illustrating an exemplary method of manufacturing the MOV device shown in FIG. 4*a;*

Referring to FIG. 4*b*, a flow diagram illustrating an exemplary method for manufacturing the above-described MOV device 40 in accordance with the present disclosure is shown. The method will now be described in conjunction with the illustration of the MOV device 40 shown in FIG. 4*a*.

At block 400 of the exemplary method, the MOV chip 41 may be provided. As described above, the MOV chip 41 may, in one non-limiting example, be formed of zinc oxide granules embedded in ceramic. In various other embodiments, the MOV chip 41 may be formed of any of a variety of other MOV compositions known in the art for providing transient voltage suppression.

At block 410 of the exemplary method, the first base metal electrode layers 43 may be formed on opposite sides of the MOV chip 41. This may be accomplished by screen-printing thin layers of aluminum paste on the opposite sides of the MOV chip 41 using conventional screen-printing processes. Subsequently, at block 420 of the method, the screen-printed layers of aluminum paste may be fired, whereby the aluminum paste is hardened and securely adhered to the surfaces of the MOV chip 41. In a non-limiting example, each of the first base metal electrode layers 43 may have a thickness in a range of 5-30 micrometers and a surface area that is in a range of 60-90% of the surface area A of a side of the MOV chip 41.

At block 430 of the exemplary method, the second base metal electrode layers 44 may be formed on the first base metal electrode layers 43. This may be accomplished by screen-printing thin layers of silver paste on the surfaces of the first base metal electrode layers 43 using conventional screen-printing processes. Subsequently, at block 440 of the method, the screen-printed layers of silver paste may be fired, whereby the silver paste is hardened and securely adhered to the surfaces of the first base metal electrode layers 43. In a non-limiting example, each of the second base metal electrode layers 44 may have a thickness in a range of 2-10 micrometers and a surface area that less than 60% of the surface area of the first base metal electrode layer 43.

At block 450 of the exemplary method, the leads 45, 46 may be electrically connected to the second base metal electrode layers 44. This may be accomplished via soldering, welding, electrically conductive adhesive, etc.

Figure 5A:
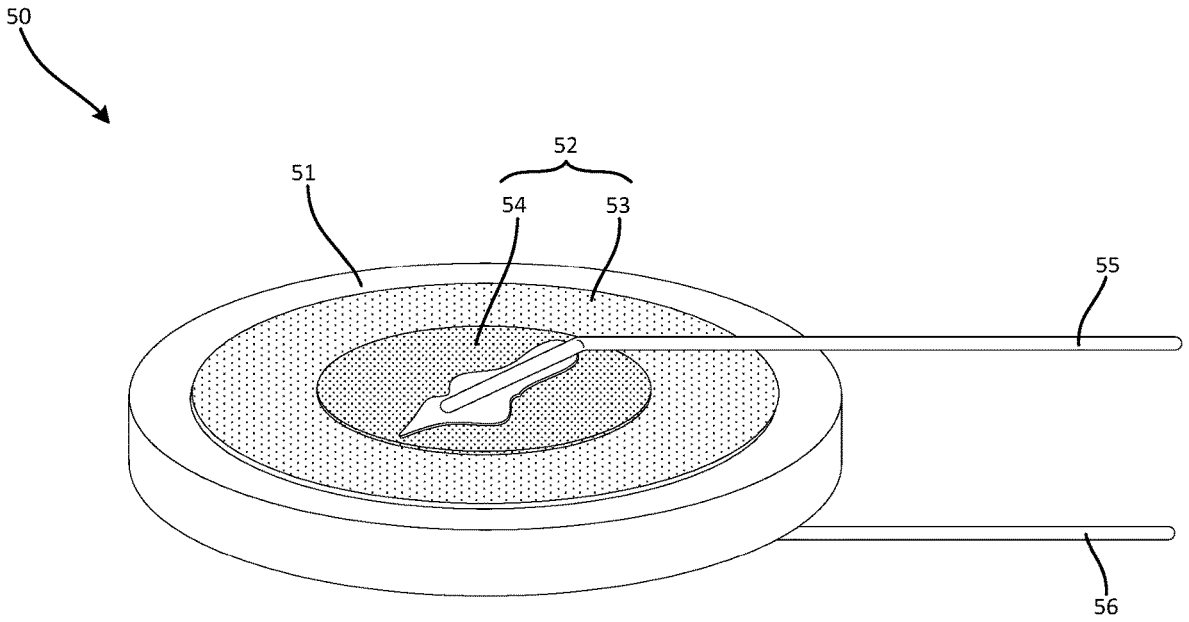
FIG. 5*a* is a perspective view illustrating a MOV device in accordance with another exemplary embodiment of the present disclosure.

Referring to FIG. 5*a*, another exemplary embodiment of a MOV device 50 in accordance with the present disclosure is shown. The MOV device 50 may include a MOV chip 51 having first and second base metal electrodes 52 disposed on opposite sides thereof. Only one side of the MOV chip 51 is visible in FIG. 5*a*, but it will be understood that the opposing side of the MOV chip 51 that is not within view may be provided with a base metal electrode that is substantially identical to the base metal electrode 52. The description of the base metal electrode 52 provided below shall therefore also apply to the base metal electrode that is not within view in FIG. 5*a*.

The MOV chip 51 may be formed of any MOV composition known in the art, including, but not limited to, zinc oxide granules embedded in ceramic. The base metal electrode 52 may include first and second base metal electrode layers 53, 54. The first base metal electrode layer 53 may be formed of a layer of aluminum that may be deposited onto the surface of the MOV chip 51 using conventional arc-spraying processes. In a non-limiting example, the first base metal electrode layer 53 may have a thickness in a range of 20-200 micrometers.

The second base metal electrode layer 54 may be formed of a thin layer of silver paste that is screen-printed onto the surface of the first base metal electrode layer 53 using conventional screen-printing processes. In a non-limiting example, the second base metal electrode layer 54 may have a thickness in a range of 2-10 micrometers. Thus, as will be appreciated by those of ordinary skill in the art, the second base metal electrode layer 54 may be significantly thinner than silver base metal electrodes of traditional MOV devices. In a non-limiting example, a side of the MOV chip 51 may have a surface area A, the first base metal electrode layer 53 may have a surface area in a range of 60-90% of A, and the second base metal electrode layer 54 may have a surface area that is less than 60% of the surface area of the first base metal electrode layer 53.

The MOV chip 51 and the first and second base metal electrode layers 53, 54 are depicted as being circular in shape, but this is not critical. It is contemplated that one or more of the MOV chip 51, the first base metal electrode layer 53, and the second base metal electrode layer 54 may have a different shape, such as rectangular, triangular, irregular, etc. without departing from the scope of the present disclosure.

The MOV device 50 may further include electrically conductive leads 55, 56 which may be connected to the second base metal electrode layers 54 for facilitating electrical connection of the MOV device 50 within a circuit. In various non-limiting embodiments, the leads 55, 56 may be electrically connected to the second base metal electrode layers 54 via soldering, welding, electrically conductive adhesive, etc.

As described above, the second base metal electrode layers 53 of the MOV device 50 are significantly thinner and smaller, and therefore require less silver, than silver base metal electrodes of traditional MOV devices. Therefore, the MOV device 50 of the present disclosure may be produced at a lower cost relative to traditional MOV devices.

Figure 5B:
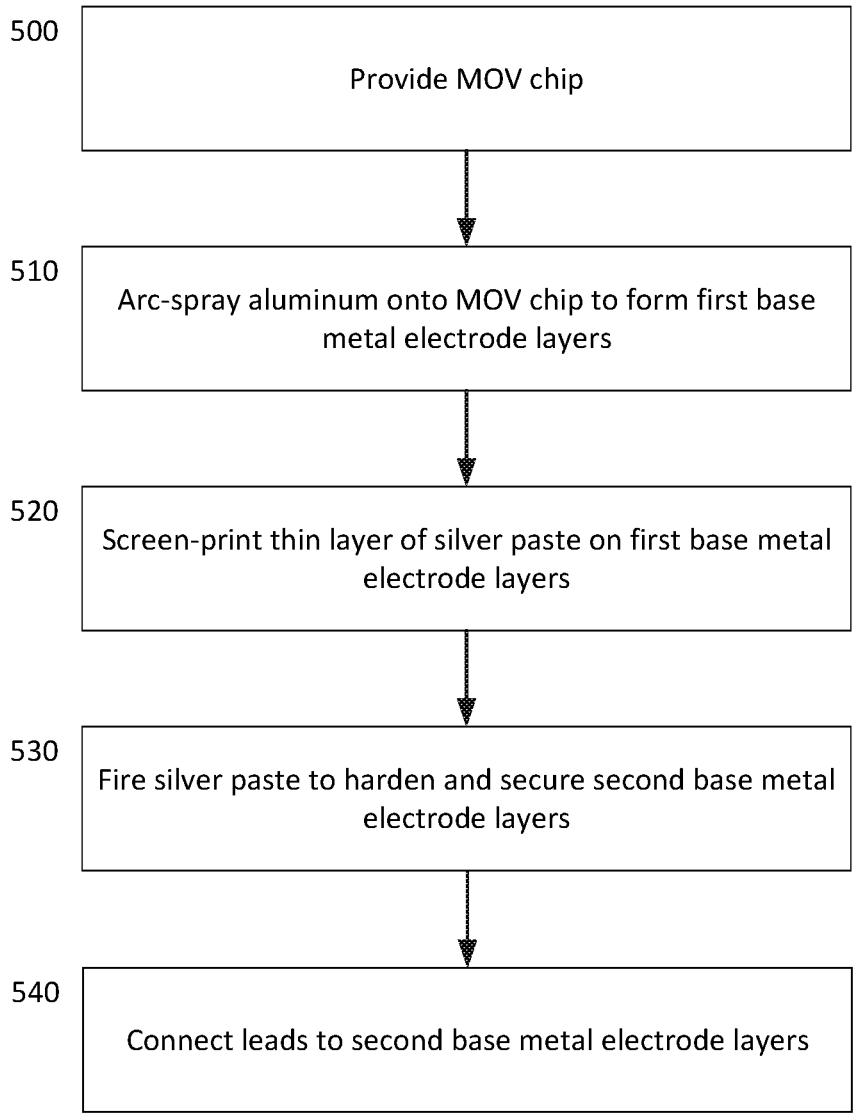
FIG. 5*b* is a flow diagram illustrating an exemplary method of manufacturing the MOV device shown in FIG. 5*a;*

Referring to FIG. 5*b*, a flow diagram illustrating an exemplary method for manufacturing the above-described MOV device 50 in accordance with the present disclosure is shown. The method will now be described in conjunction with the illustration of the MOV device 50 shown in FIG. 5*a*.

At block 500 of the exemplary method, the MOV chip 51 may be provided. As described above, the MOV chip 51 may, in one non-limiting example, be formed of zinc oxide granules embedded in ceramic. In various other embodiments, the MOV chip 51 may be formed of any of a variety of other MOV compositions known in the art for providing transient voltage suppression.

At block 510 of the exemplary method, the first base metal electrode layers 53 may be formed on opposite sides of the MOV chip 51. This may be accomplished by arc-spraying aluminum onto the surfaces of the opposite sides of the MOV chip 51 using conventional arc-spraying processes. In a non-limiting example of the method, the first base metal electrode layers 53 may be applied to the surfaces of the MOV chip 51 using first and second spray guns positioned on opposite sides of the MOV chip 51, thereby allowing the first base metal electrode layers 53 to be applied to the opposite sides of the MOV chip 51 simultaneously (or nearly simultaneously) and without changing the orientation of the MOV chip 51. In a non-limiting example, each of the first base metal electrode layers 53 may have a thickness in a range of 20-200 micrometers and a surface area that is in a range of 60-90% of the surface area A of a side of the MOV chip 51.

At block 520 of the exemplary method, the second base metal electrode layers 54 may be formed on the first base metal electrode layers 53. This may be accomplished by screen-printing thin layers of silver paste on the surfaces of the first base metal electrode layers 53 using conventional screen-printing processes. Subsequently, at block 530 of the method, the screen-printed layers of silver paste may be fired, whereby the silver paste is hardened and securely adhered to the surfaces of the first base metal electrode layers 53. In a non-limiting example, each of the second base metal electrode layers 54 may have a thickness in a range of 2-10 micrometers and a surface area that less than 60% of the surface area of the first base metal electrode layer 53.

At block 540 of the exemplary method, the leads 55, 56 may be electrically connected to the second base metal electrode layers 54. This may be accomplished via soldering, welding, electrically conductive adhesive, etc.

Figure 6A:
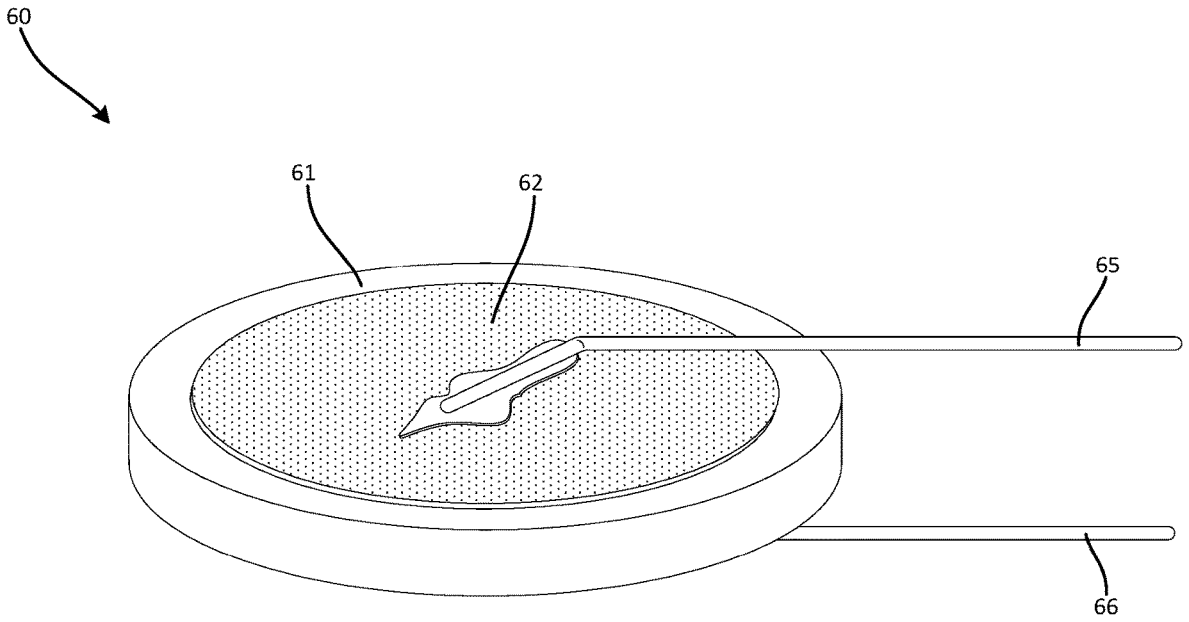
FIG. 6*a* is a perspective view illustrating a MOV device in accordance with another exemplary embodiment of the present disclosure.

Referring to FIG. 6*a*, another exemplary embodiment of a MOV device 60 in accordance with the present disclosure is shown. The MOV device 60 may include a MOV chip 61 having first and second base metal electrodes 62 disposed on opposite sides thereof. Only one side of the MOV chip 61 is visible in FIG. 6*a*, but it will be understood that the opposing side of the MOV chip 61 that is not within view may be provided with a base metal electrode that is substantially identical to the base metal electrode 62. The description of the base metal electrode 62 provided below shall therefore also apply to the base metal electrode that is not within view in FIG. 6*a*.

The MOV chip 61 may be formed of any MOV composition known in the art, including, but not limited to, zinc oxide granules embedded in ceramic. The base metal electrode 62 may be formed of a layer of aluminum paste that is screen-printed onto the surface of the MOV chip 61 using conventional screen-printing processes. In a non-limiting example, the base metal electrode 62 may have a thickness in a range of 5-30 micrometers.

The MOV chip 61 and the base metal electrode 62 are depicted as being circular in shape, but this is not critical. It is contemplated that one or more of the MOV chip 61 and the base metal electrode 62 may have a different shape, such as rectangular, triangular, irregular, etc. without departing from the scope of the present disclosure.

The MOV device 60 may further include electrically conductive leads 65, 66 which may be connected to the base metal electrode 62 for facilitating electrical connection of the MOV device 60 within a circuit. In various non-limiting embodiments, the leads 65, 66 may be electrically connected to the base metal electrode 62 via soldering, welding, electrically conductive adhesive, etc.

As described above, the base metal electrodes 62 of the MOV device 60 are formed of aluminum and do not contain silver. Therefore, since silver is significantly more expensive than aluminum, the MOV device 60 of the present disclosure may be produced at a lower cost relative to traditional MOV devices that include base metal electrodes formed of silver.

Figure 6B:
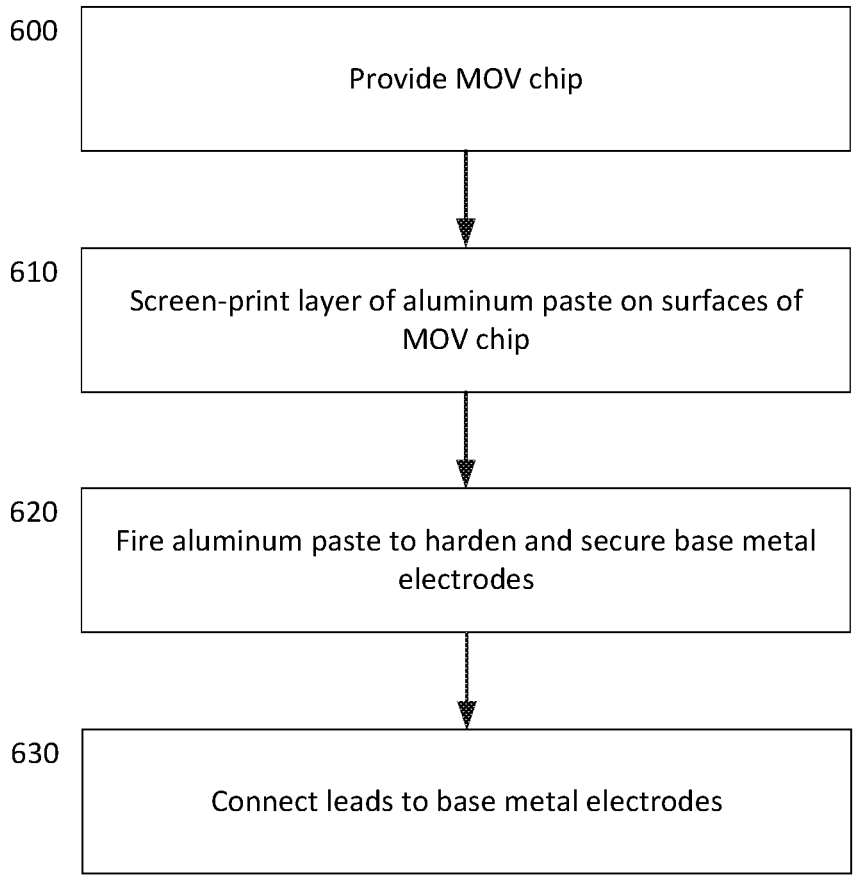
FIG. 6*b* is a flow diagram illustrating an exemplary method of manufacturing the MOV device shown in FIG. 6*a;*

Referring to FIG. 6*b*, a flow diagram illustrating an exemplary method for manufacturing the above-described MOV device 60 in accordance with the present disclosure is shown. The method will now be described in conjunction with the illustration of the MOV device 60 shown in FIG. 6*a*.

At block 600 of the exemplary method, the MOV chip 61 may be provided. As described above, the MOV chip 61 may, in one non-limiting example, be formed of zinc oxide granules embedded in ceramic. In various other embodiments, the MOV chip 61 may be formed of any of a variety of other MOV compositions known in the art for providing transient voltage suppression.

At block 610 of the exemplary method, the base metal electrodes 62 may be formed on opposite sides of the MOV chip 61. This may be accomplished by screen-printing layers of aluminum paste on the opposite sides of the MOV chip 61 using conventional screen-printing processes. Subsequently, at block 620 of the method, the screen-printed layers of aluminum paste may be fired, whereby the aluminum paste is hardened and securely adhered to the surfaces of the MOV chip 61. In a non-limiting example, the base metal electrodes 62 may have a thickness in a range of 5-30 micrometers.

At block 630 of the exemplary method, the leads 65, 66 may be electrically connected to the base metal electrodes 62. This may be accomplished via soldering, welding, electrically conductive adhesive, etc.

Figure 7A:
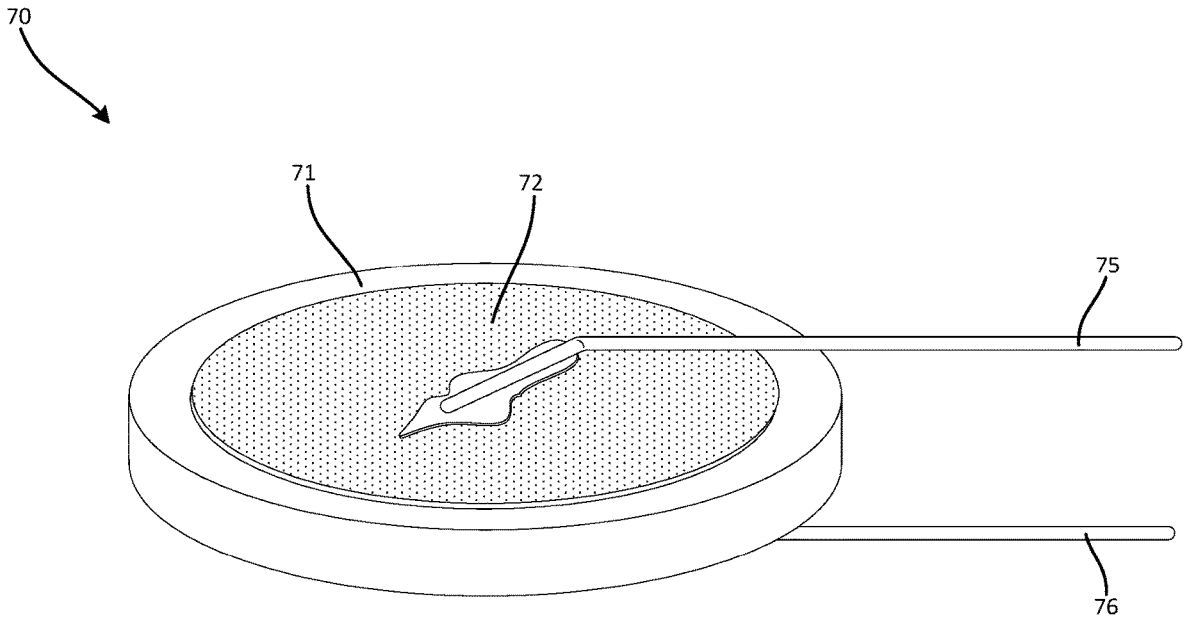
FIG. 7*a* is a perspective view illustrating a MOV device in accordance with another exemplary embodiment of the present disclosure.

Referring to FIG. 7*a*, another exemplary embodiment of a MOV device 70 in accordance with the present disclosure is shown. The MOV device 70 may include a MOV chip 71 having first and second base metal electrodes 72 disposed on opposite sides thereof. Only one side of the MOV chip 71 is visible in FIG. 7*a*, but it will be understood that the opposing side of the MOV chip 71 that is not within view may be provided with a base metal electrode that is substantially identical to the base metal electrode 72. The description of the base metal electrode 72 provided below shall therefore also apply to the base metal electrode that is not within view in FIG. 7*a*.

The MOV chip 71 may be formed of any MOV composition known in the art, including, but not limited to, zinc oxide granules embedded in ceramic. The base metal electrode 72 may be formed of a layer of aluminum that is applied to the surface of the MOV chip 71 using conventional arc-spraying processes. In a non-limiting example, the base metal electrode 72 may have a thickness in a range of 20-200 micrometers.

The MOV chip 71 and the base metal electrode 72 are depicted as being circular in shape, but this is not critical. It is contemplated that one or more of the MOV chip 71 and the base metal electrode 72 may have a different shape, such as rectangular, triangular, irregular, etc. without departing from the scope of the present disclosure.

The MOV device 70 may further include electrically conductive leads 75, 76 which may be connected to the base metal electrode 72 for facilitating electrical connection of the MOV device 70 within a circuit. In various non-limiting embodiments, the leads 75, 76 may be electrically connected to the base metal electrode 72 via soldering, welding, electrically conductive adhesive, etc.

As described above, the base metal electrodes 72 of the MOV device 70 are formed of aluminum and do not contain silver. Therefore, since silver is significantly more expensive than aluminum, the MOV device 70 of the present disclosure may be produced at a lower cost relative to traditional MOV devices that include base metal electrodes formed of silver.

Figure 7B:
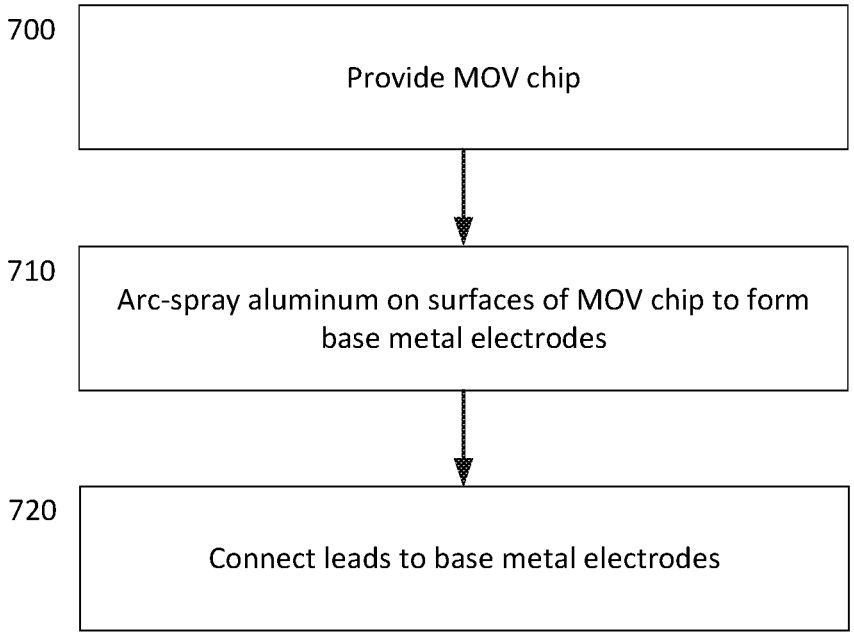
FIG. 7*b* is a flow diagram illustrating an exemplary method of manufacturing the MOV device shown in FIG. 7*a*.

Referring to FIG. 7*b*, a flow diagram illustrating an exemplary method for manufacturing the above-described MOV device 70 in accordance with the present disclosure is shown. The method will now be described in conjunction with the illustration of the MOV device 70 shown in FIG. 7*a*.

At block 700 of the exemplary method, the MOV chip 71 may be provided. As described above, the MOV chip 71 may, in one non-limiting example, be formed of zinc oxide granules embedded in ceramic. In various other embodiments, the MOV chip 71 may be formed of any of a variety of other MOV compositions known in the art for providing transient voltage suppression.

At block 710 of the exemplary method, the base metal electrodes 72 may be formed on opposite sides of the MOV chip 71. This may be accomplished by applying layers of aluminum to the opposite sides of the MOV chip 71 using conventional arc-spraying processes. In a non-limiting example of the method, the base metal electrodes 72 may be applied to the surfaces of the MOV chip 71 using first and second spray guns positioned on opposite sides of the MOV chip 71, thereby allowing the base metal electrodes 72 to be applied simultaneously (or nearly simultaneously) and without changing the orientation of the MOV chip 71. In a non-limiting example, the base metal electrodes 72 may have a thickness in a range of 20-200 micrometers.

At block 720 of the exemplary method, the leads 75, 76 may be electrically connected to the base metal electrodes 72. This may be accomplished via soldering, welding, electrically conductive adhesive, etc.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A metal oxide varistor (MOV) device comprising:

a MOV chip;

a first base metal electrode disposed on a first side of the MOV chip; and a second base metal electrode disposed on a second side of the MOV chip opposite the first side;

each of the first base metal electrode and the second base metal electrode comprising:

a first base metal electrode layer disposed on a surface of the MOV chip and formed of one of silver, copper, and aluminum, the first base metal electrode layer having a thickness in a range of 2-200 micrometers; and a second base metal electrode layer disposed on a surface of the first base metal electrode layer and formed of one of silver, copper, and aluminum, the second base metal electrode layer having a thickness in a range of 2-200 micrometers;

wherein each of the first base metal electrode layers are formed of aluminum, have a thickness in a range of 20-200 micrometers, and have a surface area in a range of 60-90% of respective surface areas of the surfaces of the MOV chip on which the first base metal electrode layers are disposed, and wherein each of the second base metal electrode layers are formed of silver, have a thickness in a range of 2-10 micrometers, and have a surface area that is less than 60% of respective surface areas of the surfaces of the first base metal electrode layers on which the second base metal electrode layers are disposed.

2. The MOV device of claim 1, wherein each of the first base metal electrode layers are formed of silver and have a thickness in a range of 2-10 micrometers, and wherein each of the second base metal electrode layers are formed of copper and have a thickness in a range of 20-200 micrometers.

3. The MOV device of claim 1, wherein each of the first base metal electrode layers are formed of aluminum and have a thickness in a range of 20-200 micrometers, and wherein each of the second base metal electrode layers are formed of copper and have a thickness in a range of 20-200 micrometers.

4. A method of forming a metal oxide varistor (MOV) device comprising:

providing a MOV chip;

forming first base metal electrode layers on opposing first and second sides of the MOV chip, the first base metal electrode layers formed of one of silver, copper, and aluminum and having thicknesses in a range of 2-200 micrometers; and forming second base metal electrode layers on the first base metal electrode layers, the second base metal electrode layers formed of one of silver, copper, and aluminum and having thicknesses in a range of 2-200 micrometers;

wherein forming the first base metal electrode layers comprises arc-spraying aluminum on the first and second sides of the MOV chip, the first base metal electrode layers having thicknesses in a range of 20-200 micrometers and surface areas in a range of 60-90% of respective surface areas of the surfaces of the MOV chip on which the first base metal electrode layers are disposed, and wherein forming each of the second base metal electrode layers comprises screen printing silver on the first base metal electrode layers, the second base metal electrode layers having thicknesses in a range of 2-10 micrometers and surface areas that are less than 60% of respective surface areas of the surfaces of the first base metal electrode layers on which the second base metal electrode layers are disposed.

5. The method of claim 4, further comprising connecting leads to the first and second base metal electrode layers.

* * * * *